US011541965B2

(12) United States Patent
Armstrong

(10) Patent No.: US 11,541,965 B2
(45) Date of Patent: Jan. 3, 2023

(54) MARITIME HATCH

(71) Applicant: Lionfish Technologies LLC, Temple, TX (US)

(72) Inventor: Stephen Tyler Armstrong, Temple, TX (US)

(73) Assignee: Lionfish Technologies LLC, Temple, TX (US)

( * ) Notice: Subject to any disclaimer, the term of this patent is extended or adjusted under 35 U.S.C. 154(b) by 13 days.

(21) Appl. No.: 17/459,202

(22) Filed: Aug. 27, 2021

(65) Prior Publication Data

US 2022/0063766 A1 Mar. 3, 2022

Related U.S. Application Data

(60) Provisional application No. 63/070,990, filed on Aug. 27, 2020.

(51) Int. Cl.
*B63B 19/19* (2006.01)
*B63B 19/26* (2006.01)

(52) U.S. Cl.
CPC ..... *B63B 19/19* (2013.01); *B63B 19/26* (2013.01)

(58) Field of Classification Search
CPC . B63B 19/00; B63B 2019/0053; B63B 19/12; B63B 19/14; B63B 19/19; B63B 19/26; E05F 11/08; E05F 15/63
USPC ..... 114/201 R, 203
See application file for complete search history.

(56) References Cited

U.S. PATENT DOCUMENTS

| | | | | |
|---|---|---|---|---|
| 8,677,689 | B1 * | 3/2014 | Draper | E05F 15/63 49/281 |
| 10,731,396 | B2 * | 8/2020 | Attee | E05F 11/08 |
| 2018/0081404 | A1 | 3/2018 | Schafer et al. | |

FOREIGN PATENT DOCUMENTS

| | | | |
|---|---|---|---|
| EP | 0506329 | A1 | 9/1992 |
| GB | 2282847 | A | 4/1995 |
| GB | 2332474 | A | 6/1999 |

* cited by examiner

*Primary Examiner* — Daniel V Venne
(74) *Attorney, Agent, or Firm* — Lewis Rice LLC

(57) ABSTRACT

A two-way openable maritime hatch in which the articulating components that open the hatch, and hold it in an open position, are enclosed within a waterproof seal of the hatch when in closed position. The design uses a double hinge structure, which facilitates opening the hatch in either a forward- or aft-facing position. Elastic gaskets may be used to hold the hatch open in specific positions or at specific angles. Each of the hinge systems are independently operable.

20 Claims, 7 Drawing Sheets

MARITIME HATCH

CROSS-REFERENCE TO RELATED APPLICATIONS

This application claims benefit of U.S. Prov. Pat. No. 63/070,990, filed Aug. 2, 2020, the entire disclosure of which is incorporated herein by reference

BACKGROUND OF THE INVENTION

Field of the Invention

This disclosure is related to the field of boating, and more particularly to a two-way maritime hatch in which the articulating components are contained within a weatherproof seal when the hatch is closed.

Description of the Related Art

Despite the convenience and prevalence of flight, boating remains a popular form of transportation, both for commercial and recreational purposes. Boats, like most other forms of conveyance, usually have a number of windows, which serve both aesthetic and functional purposes. Windows permit those on the interior to enjoy the natural beauty around them, as well as provide utility in permitting passengers inside the vessel to see what is going on outside. This can assist with spotting dangerous conditions, approaching weather, and so forth.

Some windows are also openable, which provides for emergency egress in the event of a need to evacuate the vessel. Windows on a boat are generally water sealed and weatherproofed, which inhibits the intrusion of water or other moisture. Although this is a common feature of windows on many conveyances, it is particularly important on a boat which, by its nature, is always surrounded by water. The need for such windows to be waterproofed is particularly acute for hatches, because waves and other sources of moisture can cause standing water to accumulate above the hatch, which can increase the risk of water intrusion.

Another useful function of the hatch is to provide ventilation to the interior cabin of a vessel, which, again, is otherwise generally weatherproofed, which inhibits the free flow of oxygen. A hatch is typically a rectangular window, usually constructed of acrylic, with a waterproof seal. Hatches are usually mounted between the interior cabin and the top deck of a vessel. A hatch is usually openable via a hinge mounted on one edge, either facing forward or aft. The hatch typically swings open upwards by about 90 degrees for ventilation of the cabin.

A hatch generally has a metal rectangular base mounted to the deck using a combination of adhesives and mechanical connections, such as hardware. A hinge bracket is mounted to the rectangular base. This hinge bracket is adapted to connect to a similar bracket mounted to a window element. The window element may have a metal outer ring, depending on the design. An environmental gasket is also included, either mounted to the base or to the window, again depending on the design. When the hatch is closed, the gasket is compressed, forming a watertight seal. The hatch can be locked in the closed position by a handle accessible from the inside. The handle is usually pivotably attached such that it may be twisted to latch under a protruding element incorporated in the base or deck.

Hatches are typically equipped with a friction hinge. This mechanism uses an extendable cylinder disposed in the middle section of the hinge. As the cylinder is twisted, it extends and applies pressure to the sections of the hinge on opposing sides, which are mounted to the window element. The terminating ends of the cylinder protrude through the window section of the hinge and are slotted into mating features in the portion of the hinge mounted to the base. This engagement prevents rotation of the cylinder relative to the hinge portion mounted to the base. The accumulation of pressure between the mating portion of the cylinder and the window hinge increases the friction in the hinge, which assists with maintaining the window element in a desired orientation or position by friction.

The extendable cylinder at the core of the hinge works in a manner similar to a screw and nut, and is sometimes referred to in the art as a jacking nut and bolt. The bolt is inserted into the nut, and as the nut is rotated, it slides proximal or distal to the bolt. Thus, the cylinder is comprised of two corresponding cylindrical bodies, a first body in the nature of a bolt having a protruding external thread on its outer surface, and a second body in the nature of a nut, having a corresponding thread on its inner surface, where the first body is inserted into the second body. The friction can be adjusted by inserting a thin tool into a bore hole radially disposed in each body to counter rotate the elements.

The friction hinge mechanism may be supplemented by a secondary hinge bracket that utilizes a spring to resist closing motion. This secondary bracket is usually much larger, and generally in a clamshell configuration mounted from the rectangular base frame to the window element, and usually inward of the environmental seal. The spring is connected such that the spring is relaxed, or untensioned when the bracket is in "open" position. As the window element is rotated towards closed position (i.e., towards the rectangular base), the spring is tensioned, and thereby resists closure of the hatch. Both elements work in tandem to support the window element in an open position, without falling closed due to the pull of gravity, or the general motion of the vessel. Due to size constraints, the threads in the friction hinge center cylinder are small, and the adjustment tool holes are also small.

Over time and repeated use, the, the cylinder may begin to relax, or the threaded portion may begin to back out and do not engage as firmly, causing the friction cylinder to eventually begin to lose its ability to apply pressure, and fail. Also, the friction hinge is located exterior to the environmental seal, and thus is not protected from the marine environment. Water, and especially saltwater, is hard on metals, and the parts eventually corrode. Once corroded, the small threads may seize in place, which allows the hinge to open fully, including beyond its design range. When the hatch is opened beyond the design range, the window pivots over the deck, which acts as a fulcrum and applies a leverage force to the base and hinge. This eventually results in complete mechanical failure of the hatch.

SUMMARY OF THE INVENTION

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein, among other things, is a maritime hatch comprising: a base element in the configuration of a frame surrounding a central opening, the base element having a bottom side and an opposing top side; a weatherproofing element having a bottom side and an opposing top side, the bottom side of the weatherproofing element disposed on the top side of the base element, and the weatherproofing element disposed along the frame and surrounding the central opening; a window element comprising a top side and an opposing bottom side; an opening system attaching the window element to the base element, the opening system comprising: a first base hinge element rotatably attached to the base element at a first corner of the base element; a second base hinge element rotatably attached to the base element at a second corner of the base element, the second corner of the base element being adjacent to the first corner of the base element; a first window hinge element rotatably attached to the window element at a first corner of the window element, the first window hinge element connected to the first base hinge element by a first connection arm; a second window hinge element rotatably attached to the window element at a second corner of the window element, the second corner of the window element being adjacent to the first corner of the window element, and the second window hinge element connected to the second base hinge element by a second connection arm; wherein the first base hinge element, the first window hinge element, and the first connection arm are a mirror image of the second base hinge element, the second window hinge element, and the second connection arm; wherein the window element is sized and shaped such that when the hatch is closed, the window element is held against the top side of the weatherproofing element to form a seal effective to inhibit moisture penetration between the weatherproofing element and window element.

In an embodiment, the base element is generally in the configuration of a rounded rectangle.

In a further embodiment, the base element is sized and shaped to facilitate passage of an adult human through the central opening.

In a further embodiment, the window element is generally planer.

In a further embodiment, the window element is transparent.

In a further embodiment, the window element is translucent.

In a further embodiment, when the hatch is closed, the window element held against the top side of the weatherproofing element forms a watertight seal.

In a further embodiment, the weatherproofing element comprises a rubber gasket.

In a further embodiment: the base element further comprises at least one locking element disposed in the base element; and the window element further comprises at least one latch pivotably disposed on the bottom side of the window element, the at least one latch comprising a handle element and a latching extension; wherein the handle element is operable to rotate the latching extension to be received by the at least one locking element when the hatch is closed.

In a further embodiment, the at least one latch comprises four latches, each latch of the four latches disposed adjacent a corresponding locking element in the base element.

In a further embodiment, the first base hinge element and the second base hinge element are coaxially attached to the base element at a first axle of rotation.

In a further embodiment, when the first base hinge element and the second base hinge element are rotated at the first axle of rotation, the window element opens in a first direction hinged at the first axle of rotation.

In a further embodiment, the first window hinge element and the second window hinge element are coaxially attached to the window element at a second axle of rotation.

In a further embodiment, when the first window hinge element and the second window hinge element are rotated at the second axle of rotation, the window element opens in a second direction hinged at the second axle of rotation.

In a further embodiment, the first base hinge element and the second base hinge element are operable independently of the first window hinge element and the second window hinge element.

In a further embodiment, the first direction and second direction are opposing directions.

In a further embodiment, the first base hinge element and the second base hinge element each comprise an elastic gasket disposed therein, the elastic gasket imparting compressive friction to each of the first base hinge element and the second base hinge element effective to prevent rotation of the first base hinge element and the second base hinge element under the force of gravity alone.

In a further embodiment, the first window hinge element and the second window hinge element each comprise an elastic gasket disposed therein, the each elastic gasket imparting compressive friction to each of the first window hinge element and the second window hinge element effective to inhibit rotation of the first window hinge element and the second window hinge element under the force of gravity alone.

In a further embodiment, when the hatch is closed, the opening system is contained within the weatherproofing element and the window element.

In a further embodiment, the hatch is installed on a vessel to cover a porthole.

DESCRIPTION OF THE PREFERRED EMBODIMENT(S)

The following detailed description and disclosure illustrates by way of example and not by way of limitation. This description will clearly enable one skilled in the art to make and use the disclosed systems and methods, and describes several embodiments, adaptations, variations, alternatives and uses of the disclosed systems and methods. As various changes could be made in the above constructions without departing from the scope of the disclosures, it is intended that all matter contained in the description or shown in the accompanying drawings shall be interpreted as illustrative and not in a limiting sense.

Described herein, among other things, is a two-way openable maritime hatch in which the articulating components that open the hatch, and hold it in an open position, are enclosed within a waterproof seal of the hatch when in closed position, which inhibits corrosion, improves lifespan, and provides easier maintenance and field repair.

Figure 1:
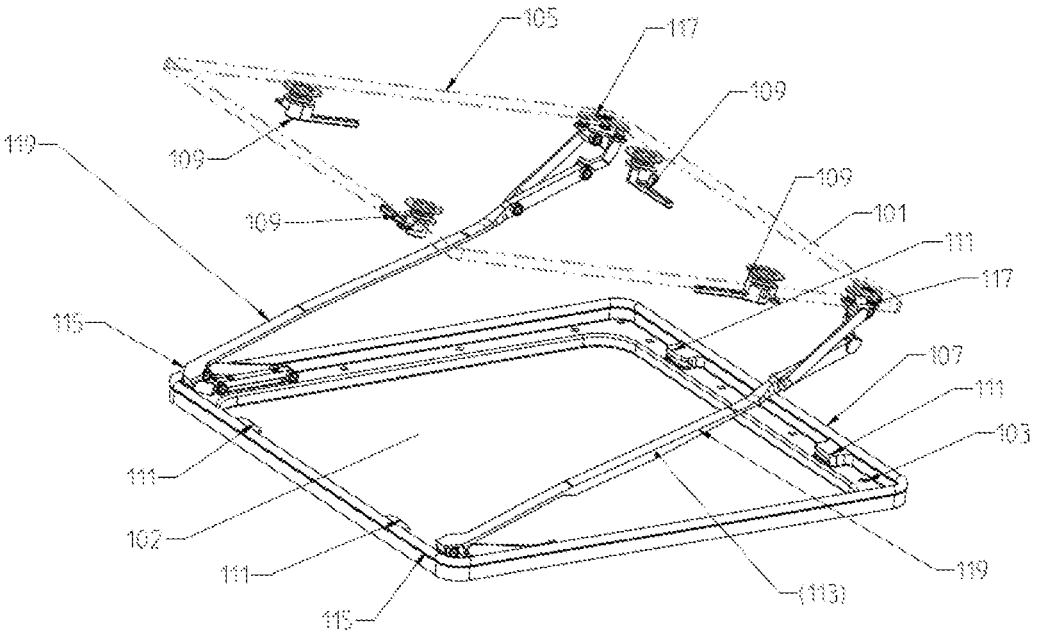
FIG. 1 provides a perspective view of a maritime hatch according to the present disclosure in a partially opened position.

FIG. 1 depicts a perspective view of a maritime hatch according to the present disclosure. In the depicted embodiment, the hatch (101) comprises a base element (103) and a window element (105) attached to each other via an opening system (113). The opening system (113) is described in further detail elsewhere herein. In the depicted embodiment of a hatch (101), the base element (103) is generally in the configuration of a rectangular frame surrounding a central opening (102). The particular dimensions of the base element (103) and opening (102) will vary from embodiment to embodiment depending upon the intended use of the hatch (101). For a small ventilation hatch (101), for example, the dimensions may be too small to permit passage of a human. However, a hatch (101) is typically sized and shaped to allow a typical adult human to pass through it, so that the hatch (101) can provide emergency egress functions. Although the depicted base element (103) is the configuration of a rectangular frame (103), in an alternative embodiment, other shapes may be used, including other polygonal configurations, as well as circular or ovoid configurations.

In the depicted embodiment, the window element (105) is a flat, planar element, generally transparent or translucent, and generally sized and shaped to have the same or similar dimensions and general shape as the base element (103). This facilitates the weather tight seal by ensuring that when the hatch (101) is closed, the window element (105) completely surrounds the exterior of the base element (103), so that a weatherproofing element (107) can inhibit the penetration of moisture or other environmental elements through the hatch (101). Although a translucent or transparent window element (105) is shown, not all hatches are required to be translucent or transparent, and a hatch may be opaque in an embodiment.

In the depicted embodiment of FIG. 1, the rectangular base element (103) comprises a weatherproofing element (107). In the depicted embodiment, the weatherproofing element (107) is disposed on a raised lid or lip about a perimeter of the base element (103). The depicted weatherproofing element (107) is sized, shaped, and positioned on the base such that when the window element (105) is closed and locked, the weatherproofing element (107) provides a watertight seal. Examples of such weatherproofing elements are known in the art and include, without limitation, rubber gaskets.

In the depicted embodiment of FIG. 1 the window element (105) further comprises a plurality of locking handles or latches (109) disposed on the bottom side of the window element (105). The bottom side is the side that faces the cabin interior when the hatch (101) is closed, allowing passengers or crew to operate the latches (109) while inside the cabin. In the depicted embodiment, four latches (109) are shown, but, in an alternative embodiment, fewer or more latches may be used, depending upon the particular design needs. Generally, enough latches (109) are provided to establish a firm connection between the window element (105) and the base element (103) sufficient to cause the mating of the window element (105) to the weatherproofing element (107) to be water resistant, watertight, waterproof, or to otherwise inhibit moisture penetration between the waterproofing element (107) and window element (105). The depicted latches (109) comprise a handle element and a corresponding latching extension. The handle may be rotated to lock the window element (105), such as by said handle extending beyond the exterior perimeter of the window element (105), sliding into a corresponding locking element (111) disposed in the base element (103), or causing an attached latching extension to slide into a locking element (111).

In the depicted embodiment, this locking element (111) is essentially a horizontal channel sized and shaped to receive the distal end of the handles of the latches (109) or the latching extension. As can be seen in the figure, these elements are typically disposed within the interior of the base element (103) such that they are protected by the weatherproofing element (107) when the hatch (101) is closed.

The design for the opening system (113) described herein provides a fully field serviceable mechanism. All components can be easily disassembled and reassembled with common tools. Certain components of the opening mechanism are protected from the environment when the hatch is closed to inhibit corrosion-related performance degradation.

At a high level of generality, the design uses a double hinge structure, which facilitates opening the hatch in either a forward- or aft-facing position. This differs from prior art designs, in which a hinge is disposed on one of two opposing edges of the base, and cannot be moved, allowing the hatch to open in only one direction. This has the problem of minimizing airflow when the wind is blowing from the mounting direction.

By contrast, the present design allows the hatch to be opened to maximize airflow depending upon which direction the wind is blowing relative to the orientation of the vessel. As can be seen in the depicted embodiment of FIG. 1, and as further described elsewhere herein with respect to the other drawings, the opening system (113) comprises a first pair of hinge systems (115) disposed at a first pair of opposing or adjacent corners of the base element (103) and a second pair of hinge elements (117) disposed at opposing or adjacent corners of the window element (105). As used herein, the term "adjacent" will be understood as referring to corners that are geometrically adjacent in the overall shape of the referenced object (i.e., as opposed being disposed diagonally opposite or having a third corner disposed between). The first set of hinge mechanisms (115) are disposed at an edge opposing the edge to which the second set of hinge elements (117) are attached. These two sets of hinge mechanisms (115) and (117) are each connected to one another via a connection arm (119).

Each of the two sets of hinges (115) and (117) can operate independently. Thus, in the depicted embodiment of FIG. 1, the window element (105) can be opened at the left side by rotating the second set of hinge elements (117), but not the first set of hinge elements (115). And, conversely, the window element (105) can be opened from the right side by rotating the first set of hinge elements (115), but not the second set of hinge elements (117).

Figure 2:
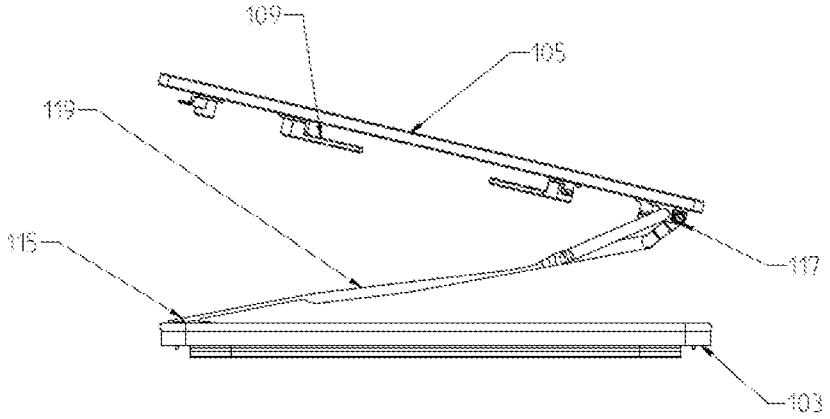
FIG. 2 provides a side elevation schematic view of a maritime hatch according to the present disclosure in a partially opened position.
Figure 3:
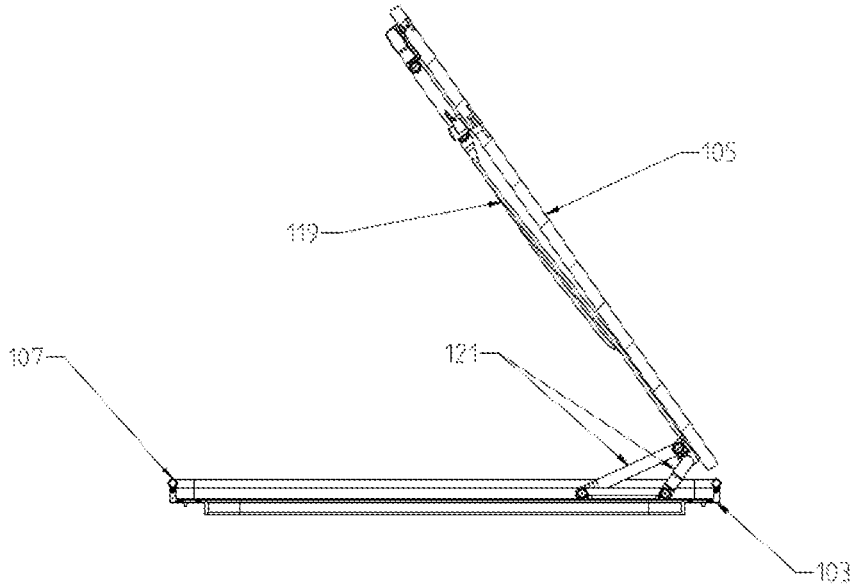
FIG. 3 provides a side elevation schematic view of a maritime hatch according to the present disclosure in an open position on one side.
Figure 4:
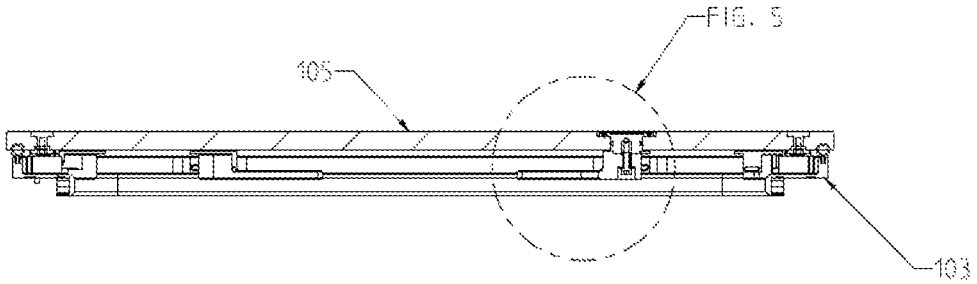
FIG. 4 provides a side elevation cutaway view of a maritime hatch according to the present disclosure in closed position.
Figure 5:
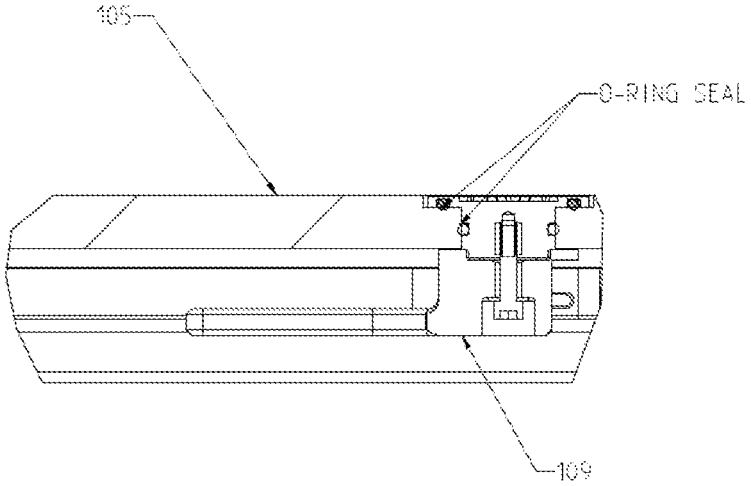
FIG. 5 provides a detailed schematic view of a portion of the maritime hatch of FIG. 4.
Figure 6:
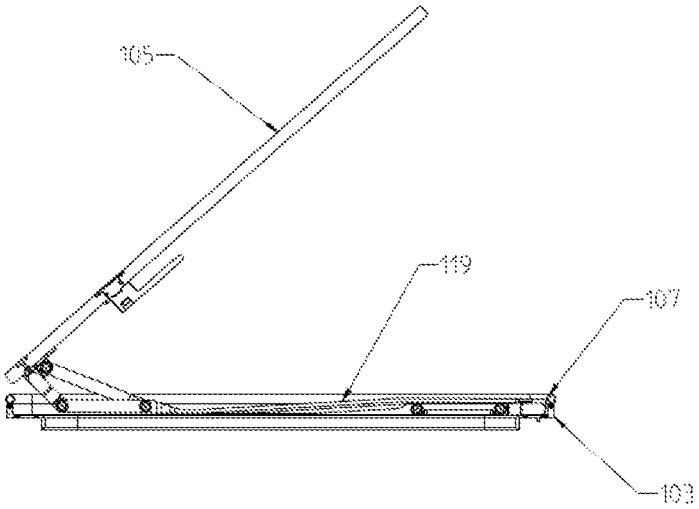
FIG. 6 depicts a side elevation schematic view of a maritime hatch according to the present disclosure in forward open position.

This arrangement can be further seen in FIG. 2, which provides a side elevation schematic view of both hinge elements being partially operated at the same time. As seen in the drawings, the connection arms (119) run along the length of the major access of the hatch (101), to connect the hinges disposed at opposing ends thereof, when the first set of hinges (115) is operated, the connection arm (119) is raised with the window element (105). By contrast, when the second set of hinge elements (117) are operated, the connection arm (119) stays in place disposed alongside the interior of the base element (103), and does not raise.

The depicted hatch assembly is comprised of six main components: a window element (105), a base element (103), hinge systems (115) and (117), a connection arm (119), a weatherproofing element (107), and latches (109). These are assembled using mechanical hardware and/or adhesives. Gaskets, or O-rings, are incorporated at moving interfaces and where environmental seal is required. The base may be comprised of machined or formed metal in a rectangular shape with rounded corners. In cross section, the base presents a lip, which rests horizontally on the deck, and a vertical lip on the inner perimeter, which protrudes downward, locating the base in the deck cutout.

The base element (103) incorporates a mounting pad for the hinge bracket, which connects to the hinge and connection arm. Around the horizontal perimeter is a groove, which serves as a guide for the adhesion of an environmental gasket. Features that interact with the window locking mechanism are incorporated at specific locations around the inner perimeter. These locking features may appear as protrusions or recessions in the base frame. The window is a rectangular panel with rounded corners, which is translucent and tinted. It is generally flat but may have complex machined features or geometry. Typically, this is constructed of acrylic but can be constructed of other materials, such as fiberglass or teak.

The components of the depicted hinge systems (115) and (117) are assembled in a "four-bar" configuration. This allows for controlled motion of the hatch (101). By defining the ratio of bar lengths with respect to each other, the opening motion of the hatch (101) causes the window element (105) to move vertically as well as rotate. The depicted unit is comprised of four linkages, with two of these linkages on the forward edge and two on the aft edge. In certain embodiments, it is possible for the dual hinge mechanism to provide sufficient additional freedom of motion to provide the ability to lie flat even in cases where the deck is at a slightly higher level than the plane of the base.

To provide the function of the window element (105) remaining in the desired position, the depicted hinges use the compression of elastic gaskets to provide sufficient friction in the hinge. The hinge bracket contains a hole. The mating piece, which attaches from the connecting bar, is a protrusion of mirrored geometry with smaller diameter, known as the "pin." A cylindrical elastomer gasket is inserted around the pin and fills the remaining space between the outer diameter of the pin and the inner diameter of the hole. The arm piece is inserted into the bracket and retained by a cap and screw from the opposite side, which is screwed into the arm piece and set in place with a retaining or keying feature. The mounted bracket is then captive, and the elastic gasket centers the parts along the same axis. Rotating the hinge requires enough force to overcome the force of friction created by the compression of the gasket. The hinge systems are located on opposite sides of the hatch assembly. The hinge systems connects the forward edge of the base to the aft edge of the window, or visa-versa. The hinge systems consist of two connection bars (known as "legs"), brackets to connect the necessary legs to either the window or the base frame, and a long connection bar, called the "arm." The cylindrical mating surfaces of the arms, legs, or brackets have a smooth finish. Friction is achieved through the implementation of a gasket material between the two interfacing parts or by direct contact of the rotating parts. The force applied by assembly fasteners increases the friction at the material interfaces (either through additional compression of the gasket or directly to the rotating body). Gaskets may also be incorporated to protect the rotation features from wear and environmental elements. The hinge mechanism is used both at the deck mount and at the window mount, on either ends of the support arm.

Two sets of locking mechanisms are provided in this design as opposed to one set in traditional designs because no edge of the hatch window is mounted directly to the lower frame. Similar methods are applied as in traditional hatches to latch the window in the closed position. A handle rotates from the unlocked to locked position by moving a protrusion from the handle under a lip in the base. The handle is assembled through a hole in the window and sealed with an environmental gasket. The handle is mounted on the underside of the window, so as to be accessible from inside. When rotated, a protrusion on the handle contacts the locking feature on the base and as the handle protrusion is rotated further along the groove in the base, a downward force is created to compress the environmental seal for the hatch. Multiple handles are incorporated in the design depending on hatch size. In most cases a minimum of two handles (forward and aft) are required clue to the dual hinge mechanism.

The following description is provided with respect to the detailed views of the hinge systems shown in FIGS. 10, 11, 12, 13, and 14. As can be seen in the exploded view of FIG. 10, the hatch (101) opens and closes, and the two-way feature is accomplished, by means of a pair of opposing hinge systems (1001A) and (1001B). The depicted hinge systems (1001A) and (1001B) are generally similar and use similar components, but they are attached to the respective mounting points differently. The depicted first hinge system (1001A) is adapted for attaching to the base element (103). In the depicted embodiment, this is done by use of an auxiliary bar (123). In an alternative embodiment, the hinge system (1001A) may be attached directly to the base element (103). However, it may be difficult to machine the necessary receivers directly into the base element (103), due to geometric limitations in production machines. As such, it may be more cost-effective, in certain embodiments, to use an auxiliary bar (123) to provide a cost-effective means for mounting the hinge system (1001A) to the base element (103).

The depicted first hinge system (1001A) is comprised of a pair of legs (121A) and (121B). Each of the depicted legs has a first pin (122A) disposed at a first end thereof, and a second pin (122B) disposed at an opposing end thereof. In the depicted embodiment of FIG. 10, the pins (122) of the second leg (121B) are disposed in receivers in the auxiliary bar (123) and the connection arm (119). As can be seen in the FIGs., the pins (122) are sized and shaped to be received by a corresponding receiver in the respective component. The auxiliary bar (123) (or, in an alternative embodiment, the base element (103)) comprises a pair of receivers adapted to receive the first pin (122A) of the first leg (121A) and the first pin of the second leg (121B). The receivers in the depicted auxiliary bar (123) are disposed at opposing ends thereof, and the auxiliary bar (123) is affixed to the base element (103) via hardware (135). The second pin (122B) of the first leg (121A) and the second pin of the second leg (121B) are each disposed in corresponding receivers disposed in the connection arm (119).

As can be seen in the drawings, these two legs (121A) and (121B) work in tandem to rotate at the receivers and provide the hinging functionality. That is, the first pin (122A) in the first arm (121A) and the first pin in the second leg (121B) rotate within the receivers in the auxiliary bar (123), causing the opposing ends of the legs (121A) and (121B) to rotate through an arc, which in turn causes the second pin (122B) in the first leg (121A) and the second pin in the second leg (121B) to rotate within their respective receivers in the connection arm (119).

As will be clear to a person of ordinary skill in the art, it is desirable to have a means or mechanism for holding the hatch (101) in open position, and preferably at a particular angle selected by the user. This functionality is provided by means of an elastic gasket (125) which is disposed between the pins (122) and the receivers (133). Although elastic gaskets are well known in the art as serving the function of encouraging or facilitating movement, in the depicted embodiment, the friction of the gasket provides a holding force that maintains the hatch in the position selected by the user.

By determining the hardness value of the elastomeric material and the overall percent of compression of the gasket, the force of friction required to hold the desired position can be established by design. This design defines a friction of the linkages in such a way that an additional support rod is not required. This is desirable to reduce the amount of material present when entering the hatch (101) from the sides. This difference from prior art linkages, which are considered to be "frictionless" and to lack holding force. Instead, prior art designs rely on the addition of a support bar, such as pneumatic, hydraulic, or spring loaded support arm to provide holding force. Such prior art support bars are known as a "stay", and would be in the way of the user in the setting of a maritime hatch.

This design defines the friction of the linkages in such a way that an additional support rod is not required. This is desirable to reduce the amount of material present when entering the hatch from the sides.

To further facilitate this functionality, and to limit the amount of counter-rotation pressure, the pins (122) are held in the receivers by use of a washer (127) and fastener (129), typically a threaded screw. The screw (129) is screwed into a receiver in the pin (122), and the washer is disposed there between.

In the depicted embodiment, the distal end of the pins (122) may have a flattened element, such as a chord, which provides a keying function. The flattened edge of the pin (122) may correspond and coordinate with a corresponding flat edge of the washer (127), which reduces the amount of counter-rotation force on the screw. This helps to reduce stress on the screw during motion and inhibit "back-out" where the rotating motion of the hinge causes the screw to become gradually unfastened. Keying may also be achieved in other embodiments though geometry other than that described above, including but not limited to concave or convex protrusions.

Figure 7:
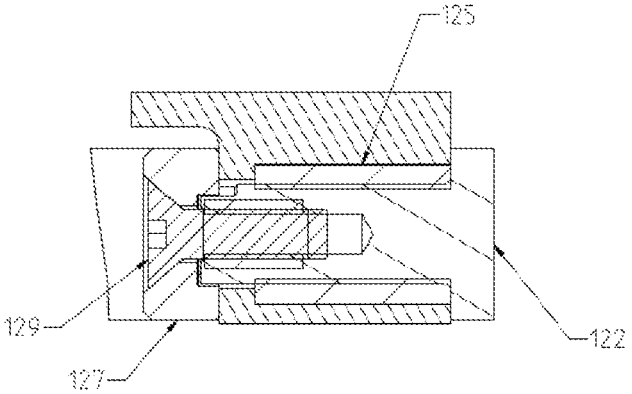
FIG. 7 depicts a detailed cross section view of the arm linkage joint and locking mechanism of a maritime hatch according to the present disclosure.
Figure 8:
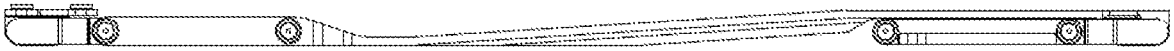
FIG. 8 depicts a detailed side view of the opening mechanism subassembly of a maritime hatch according to the present disclosure.
Figure 9:
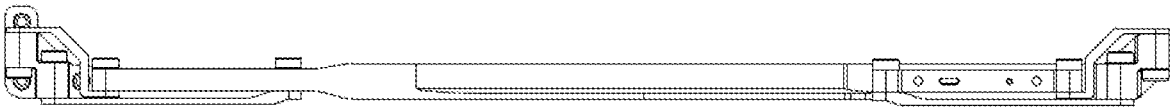
FIG. 9 depicts a detailed view of the opening mechanism subassembly of a maritime hatch according to the present disclosure.
Figure 10:
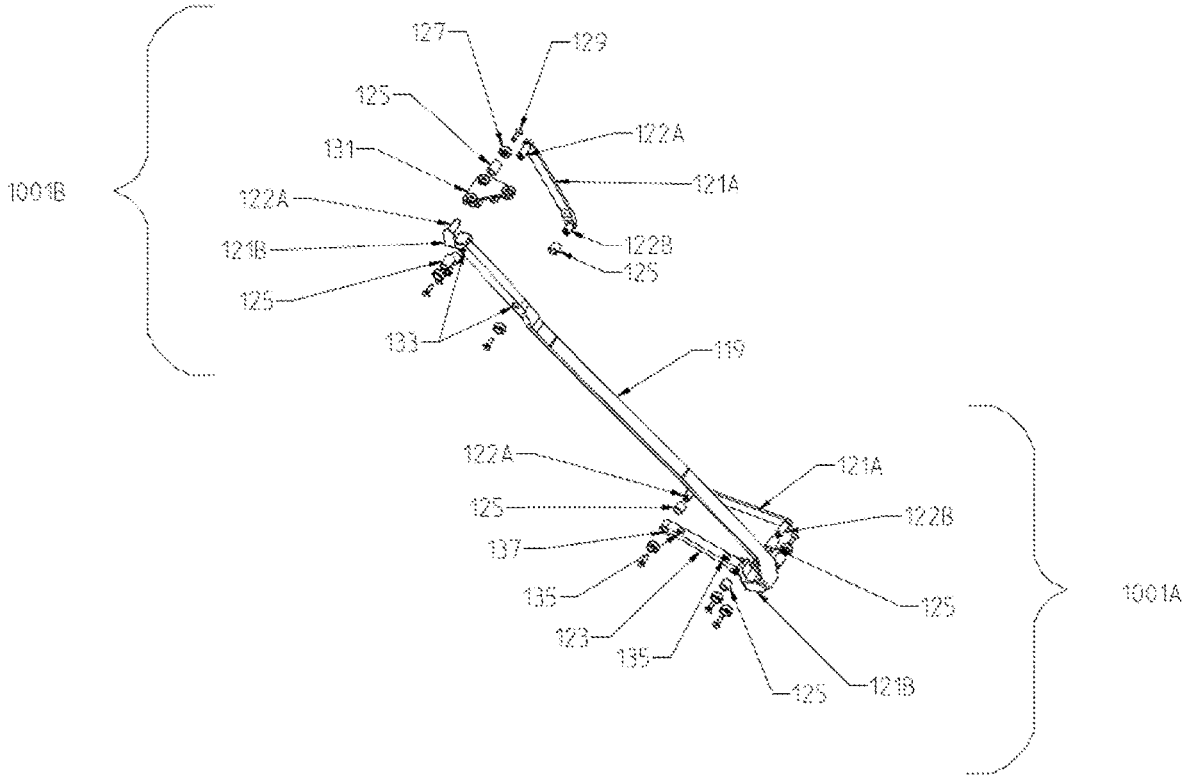
FIG. 10 depicts an exploded view of a bi-directional opening mechanism for a maritime hatch according to the present disclosure.
Figure 11:
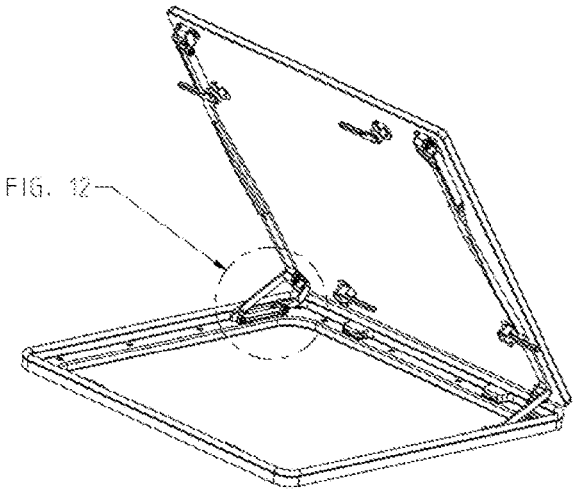
FIG. 11 depicts an isometric assembled view of a maritime hatch according to the present disclosure using the bi-directional opening mechanism of FIG. 10, with a detail callout of a first hinge system thereof.

In the depicted embodiment, the locking feature shown in FIG. 7 provides a geometry of the pins (122) and washers (127) effective to inhibit rotation relative to one another. In this way, the fastener (129) is similarly inhibited from rotating relative to the pin (122) because it is in contact with the washer (127) as well as the pin (122). This inhibits the washer (127) from rotating with the bracket due to friction when the hinge is rotated. This also assists with inhibiting the fastener from "backing out" or unscrewing itself by being rotated relative to the threads. Additionally, the depicted geometry causes the user to apply an amount of force effective to overcome the force of friction applied between the washer (127) and the components of the bracket system. This frictional force assists the force of friction created by the elastic gasket (125) to hold the hatch place.

As can be seen in the depicted embodiments, the depicted first leg (121A) is generally in the configuration of an elongated element and the pins (122) are generally in the configuration of cylinders, except for the keying element. The depicted pins (122) are disposed as opposing ends of the first leg (121A), and protrude generally perpendicularly therefrom, and are generally in parallel.

The depicted second leg (121B) has a different geometry. In the depicted embodiment, the second leg (121B) has pins at opposing ends, but the pins extend from the opposing ends in opposite directions. The depicted second leg (121B) has its first pin perpendicularly attached to a first end of the leg. The depicted first end is generally in the configuration of a thin rectangular prism, with the first pin extending generally perpendicularly from a first side thereof. The depicted second leg (121B) further comprises a body element also generally in the configuration of a thin rectangular prism, and attached at a right angle to the first end element (141). The dimensions of the first end element (141) and middle element (143) are configured so that when the second leg (121B) rotates around the second leg pin (122B) there is sufficient clearance for the second leg (121B) with respect to the auxiliary bar (123) and/or the hatch frame.

Figure 12:
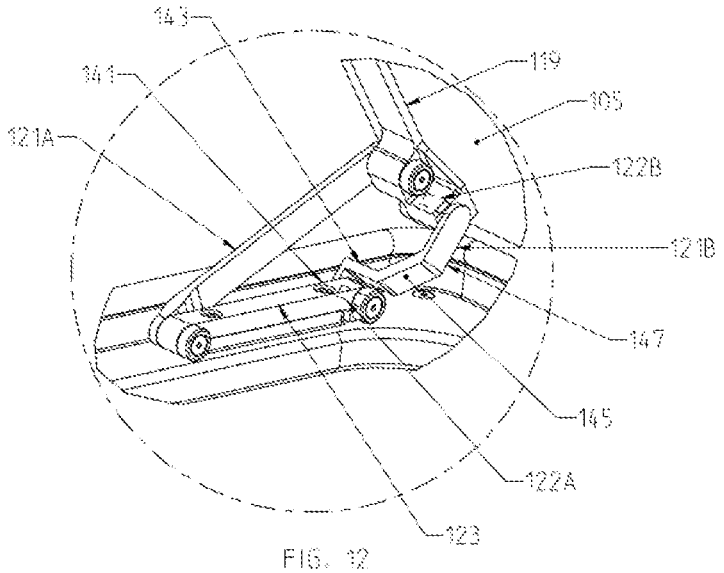
FIG. 12 depicts the detail callout of the first hinge system of the hatch of FIG. 11.
Figure 13:
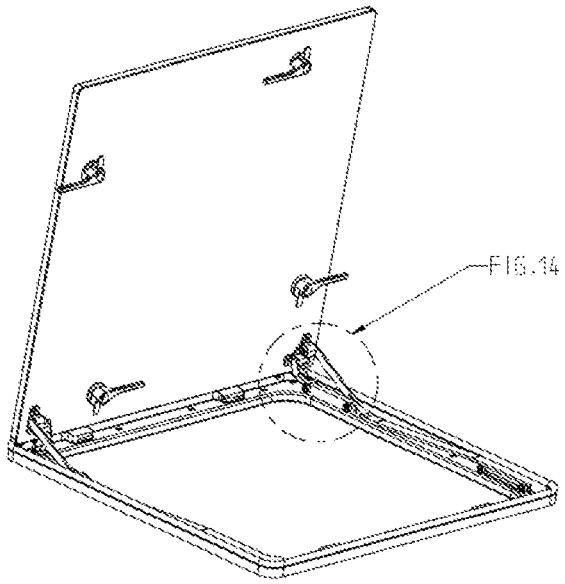
FIG. 13 depicts an isometric assembled view of a maritime hatch according to the present disclosure using the bi-directional opening mechanism of FIG. 10, with a detail callout of a second hinge system thereof.

As can be further seen in FIG. 12, attached to the middle element (143) is an angled element (145). The depicted angled element (145) is also generally in the configuration of a thin rectangular prism and is attached to the middle element (143) at an obtuse angle. As can be seen in the figure, the angled element (145) angles away from the first end element (141). Attached to the angled element (145) is a second end element (147) to which is attached the second pin (122B) of the second leg (121B). The depicted second end element (147) is also generally in the configuration of a thin rectangular prism, and is generally in a parallel plane to the first end element (141). As can be seen in the drawings, the distal ends of the first end element (141) and second end element (147) may be rounded. Also, as can be seen in FIG. 12, the second pin (122B) of the second leg (121B) extends generally perpendicularly from the plane of the second end element (147) and in a direction opposite the direction that the first pin (122A) of the second leg (121B) extends from the plane of the first end element (141).

The dimensions of all of the four component elements of the second leg (121B) are generally engineered to provide sufficient clearance when the hinge system (1001A) is in motion, and to provide adequate storage volume for the components of the hinge system (1001A) when the hatch (101) is closed. In particular, as can be seen in FIG. 12, the length of the angled element (145) and the second end element (147), along with the angles in question, provide sufficient clearance so that when the hatch (101) is closed, the end of the connection arm (119) can be stowed between the auxiliary bar (123) and the inside surface of the base element (103). It will be readily understood that other configurations, lengths, and shapes of the second leg (121B) are possible and may be suitable in an alternative embodiment to achieve the same functionality within a base element (103) having a different geometry. These structures also facilitate the storage of the rotating elements of the hinge system (1001A) within the weatherproof seal beneath the window element (105).

Figure 14:
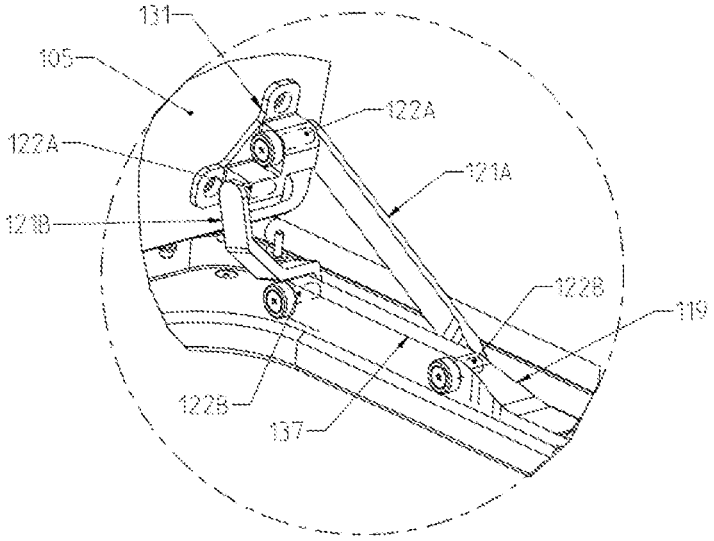
FIG. 14 depicts the detail callout of the first hinge system of the hatch of FIG. 13.

As can be seen in FIG. 14, the second hinge system (1001B) uses essentially similar components, except that instead of mounting the first leg (121A) and second leg (121B) to an auxiliary bar (123), the legs (121A and 121B) are mounted to a window-mounting element (131). The depicted window mounting element (131) is adapted for rigidly mounting to the window element (105), and comprises a pair of opposing receivers for accepting the first pin (122A) of the first leg (121A) and the first pin (122A) of the second leg (121B). In the depicted embodiment, the second pins (122B) of both the first leg (121A) and second leg (121B) are disposed in receivers machined into mounting structure (137) which comprises a portion of the connection arm (119).

In the depicted embodiment, the structure of the legs (121A) and (121B) in the second hinge system (1001B) are generally the same as those of the first hinge system (1001A). This simplifies manufacturing and lowers costs, while also making it simpler to repair and maintain the windows by providing interchangeable parts. Thus, the description of the two depicted legs (121A) and (121B) with respect to the first hinge system (1001A) generally applies to the components depicted in FIG. 14 as well.

As can be seen in FIG. 14, the window-mounting element (131) mounts the hinge system (1001B) to the window element (105), whereas the first hinge system (1001A) is shown in FIG. 12 adjacent to the window element (105), but not mounted to it. This allows the first hinge assembly to be rotated to open the window element (105) in a first direction opposite the location of the first hinge system (1001A) and/or to allow the second hinge system (1001B) to open the window element (105) in a direction opposite the location of the second hinge system (1001B). As with the first hinge system (1001A), the window element (105) is held in place in open position using elastic gaskets (125), and similar keying features that cooperate with the washer (127) and screw (129).

These components work together to facilitate the two-way opening function of the hatch window, while also storing the moving pieces within the weatherproof seal when the hatch is closed.

The depicted assemblies of FIGS. 10 through 14 concern only one side of the hatch. As seen in the other figures, a mirrored set of components is disposed at the opposing side of the hatch to provide two points of rotation for the window element (105). Also, because the hatch (101) can open from either end, a set of latches (109) are provided at each end of the hatch (101), which can lock into place in a manner that would be familiar to one of ordinary skill in the art. In the depicted embodiment, four total handles are provided to ensure a good seal, but in alternative embodiments, more or fewer handles may be provided, depending upon the size and shape of the window element (105).

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A maritime hatch comprising:

a base element in a configuration of a frame surrounding a central opening, said base element having a bottom side and an opposing top side;

a weatherproofing element having a bottom side and an opposing top side, said bottom side of said weatherproofing element disposed on said top side of said base element, and said weatherproofing element disposed along said frame and surrounding said central opening;

a window element comprising a top side and an opposing bottom side;

an opening system attaching said window element to said base element, said opening system comprising:

a first base hinge element rotatably attached to said base element at a first corner of said base element;

a second base hinge element rotatably attached to said base element at a second corner of said base element, said second corner of said base element being adjacent to said first corner of said base element;

a first window hinge element rotatably attached to said window element at a first corner of said window element, said first window hinge element connected to said first base hinge element by a first connection arm;

a second window hinge element rotatably attached to said window element at a second corner of said window element, said second corner of said window element being adjacent to said first corner of said window element, and said second window hinge element connected to said second base hinge element by a second connection arm;

wherein said first base hinge element, said first window hinge element, and said first connection arm are a mirror image of said second base hinge element, said second window hinge element, and said second connection arm;

wherein said window element is sized and shaped such that when said hatch is closed, said window element is held against said top side of said weatherproofing element to form a seal effective to inhibit moisture penetration between said weatherproofing element and window element.

2. The hatch of claim 1, wherein said base element is generally in the configuration of a rounded rectangle.

3. The hatch of claim 1, wherein said base element is sized and shaped to facilitate passage of an adult human through said central opening.

4. The hatch of claim 1, wherein said window element is generally planer.

5. The hatch of claim 4, wherein said window element is transparent.

6. The hatch of claim 4, wherein said window element is translucent.

7. The hatch of claim 1, wherein when said hatch is closed, said window element held against said top side of said weatherproofing element forms a watertight seal.

8. The hatch of claim 1, wherein said weatherproofing element comprises a rubber gasket.

9. The hatch of claim 1, wherein:

said base element further comprises at least one locking element disposed in said base element; and said window element further comprises at least one latch pivotably disposed on said bottom side of said window element, said at least one latch comprising a handle element and a latching extension;

wherein said handle element is operable to rotate said latching extension to be received by said at least one locking element when said hatch is closed.

10. The hatch of claim 9, wherein said at least one latch comprises four latches, each latch of said four latches disposed adjacent a corresponding locking element in said base element.

11. The hatch of claim 1, wherein said first base hinge element and said second base hinge element are coaxially attached to said base element at a first axle of rotation.

12. The hatch of claim 11, wherein when said first base hinge element and said second base hinge element are rotated at said first axle of rotation, said window element opens in a first direction hinged at said first axle of rotation.

13. The hatch of claim 12, wherein said first window hinge element and said second window hinge element are coaxially attached to said window element at a second axle of rotation.

14. The hatch of claim 13, wherein when said first window hinge element and said second window hinge element are rotated at said second axle of rotation, said window element opens in a second direction hinged at said second axle of rotation.

15. The hatch of claim 14, wherein said first base hinge element and said second base hinge element are operable independently of said first window hinge element and said second window hinge element.

16. The hatch of claim 15, wherein said first direction and second direction are opposing directions.

17. The hatch of claim 1, wherein said first base hinge element and said second base hinge element each comprise an elastic gasket disposed therein, said elastic gasket imparting compressive friction to each of said first base hinge element and said second base hinge element effective to prevent rotation of said first base hinge element and said second base hinge element under the force of gravity alone.

18. The hatch of claim 17, wherein said first window hinge element and said second window hinge element each comprise an elastic gasket disposed therein, said each elastic gasket imparting compressive friction to each of said first window hinge element and said second window hinge element effective to inhibit rotation of said first window hinge element and said second window hinge element under the force of gravity alone.

19. The hatch of claim 1, wherein when said hatch is closed, said opening system is contained within said weatherproofing element and said window element.

20. The hatch of claim 1, wherein said hatch is installed on a vessel to cover a porthole.

* * * * *